US005590668A

United States Patent [19]

Macy

[11] Patent Number: 5,590,668

[45] Date of Patent: Jan. 7, 1997

[54] HAIR BRAIDING METHOD AND DEVICE

[76] Inventor: Joyce Macy, 8615 Millet, St. Louis, Mo. 63114

[21] Appl. No.: 458,514

[22] Filed: Jun. 2, 1995

[51] Int. Cl.[6] ..... A45D 7/00; A45D 8/30

[52] U.S. Cl. ..... 132/200; 132/279

[58] Field of Search ..... 132/212, 145, 132/144, 273, 275, 278, 279, 200, 255, 256, 257, 258, 259, 260; D28/38–41

[56] References Cited

U.S. PATENT DOCUMENTS

| | | | |
|---|---|---|---|
| 1,135,745 | 4/1915 | Wenzlick . | |
| 1,225,831 | 5/1917 | Legere . | |
| 1,921,802 | 8/1933 | Bonat | 132/36 |
| 2,902,042 | 9/1959 | Halber | 132/133 |
| 2,998,015 | 8/1961 | Gresham et al. | 132/279 |
| 3,698,403 | 10/1972 | Morand | 132/46 |
| 3,889,692 | 6/1975 | Redrow | 132/7 |
| 3,998,233 | 12/1976 | Dorr | 132/48 |
| 4,285,350 | 8/1981 | Cox et al. | 132/9 |
| 4,307,737 | 12/1981 | Shipman | 132/9 |
| 4,369,690 | 1/1983 | Sapkus | 87/33 |
| 4,580,585 | 4/1986 | Sapkus | 132/9 |
| 5,036,870 | 8/1991 | Edmark | 132/273 |
| 5,082,011 | 1/1992 | Wu | 132/281 |
| 5,165,430 | 11/1992 | Porter | 132/279 |
| 5,261,428 | 11/1993 | Wu | 132/281 |

FOREIGN PATENT DOCUMENTS

| | | | |
|---|---|---|---|
| 2481897 | 11/1981 | France | 132/278 |

OTHER PUBLICATIONS

Hang Shing Manufactory, ponytail holders and hair clasps.
Hang Sun Accessories Ltd., Hong Kong Ent. (Jun. 1995).
Best Source of Quality Acc., Garment & Fashion Acc.
Easy Braid, Hints and Tips for Beautiful Braids with "Easy Braid" product photographs; Willow Works Marketing Group; 1995.
Johnson et al., Braids and Bows; Klutz Press; Palo Alto, CA (1992).
French Braiding Made Simple; TeleBrands; Roanoke, VA.

*Primary Examiner*—Todd E. Manahan
*Attorney, Agent, or Firm*—Senniger, Powers, Leavitt & Roedel

[57] ABSTRACT

A hair-braiding device which has a plurality of hair retainers for holding separate groupings of hair. The hair retainers have a perimeter member which is formed with an opening therein for insertion and securement of hair groupings therein. A method for braiding hair using a plurality of hair retainers having openings therein for insertion and securement of separate groupings of hair therein.

13 Claims, 5 Drawing Sheets

HAIR BRAIDING METHOD AND DEVICE

BACKGROUND OF THE INVENTION

This invention relates to a device for use in braiding hair and to a method for braiding hair.

Braiding one's own hair is difficult because it is difficult to maintain the several hair groupings consistent and separate from each other. This is especially true when one is braiding his or her own hair, due to the awkwardness of reaching behind the head during the braiding process. It is also difficult to maintain the braid with one hand while gathering additional hair to be charged to the braid with the other hand. Furthermore, one often loses track of the progress of the braiding operation, forgetting which of, for example, three hair groupings is the next to be manipulated to achieve the desired braid. Accordingly, there is a need for a hair braiding device which is relatively simple to operate, constructed of inexpensive materials, portable, and of relatively simple design such that it can be relatively easily manufactured. There is also a need for a method for braiding hair which is simple, results in the consistent production of attractive braids, and is not time-consuming.

SUMMARY OF THE INVENTION

It is an object of this invention to provide a device for braiding hair which is simple to operate, constructed of inexpensive materials, portable, and relatively easy to manufacture. It is a further object to provide a method for braiding hair which is simple, results in the consistent production of attractive braids, and is not time-consuming.

Briefly, therefore, the invention is directed to a hair-braiding device comprising a plurality of hair retainers for holding separate groupings of hair. Each of the hair retainers has a perimeter member which is formed with an opening therein for insertion and securement of one of the hair groupings. Each hair retainer also has tactile indicator with the tactile indicators of the hair retainers differing from one another for enabling tactile distinguishing among the hair retainers.

The invention is also directed to a hair-braiding device comprising a plurality of hair retainers for holding separate groupings of hair. Each hair retainer has a perimeter member which is formed with an opening therein for insertion and securement of one of the hair groupings. Each hair retainer has a connector thereon for releasable connection to one of the other hair retainers.

The invention is further directed to hair-braiding device comprising a plurality of hair retainers for holding separate groupings of hair. Each of the hair retainers has a perimeter member which is formed with an opening therein for insertion and securement of one of the hair groupings and each of the perimeter members is split so as to comprise a first perimeter half and a respective mating second perimeter half. Each of the first perimeter halves and each of the respective mating second perimeter halves have a hinge end and a closure end. The hinge end of each of the first perimeter halves is hingedly secured to the hinge end of its respective mating second perimeter half and the closure end of each of the first perimeter halves is releasably securable to the closure end of its respective mating second perimeter half.

Still further, the invention is directed to a method for braiding hair in which a first hair grouping is charged into a first hair retainer comprising a perimeter member which is formed with an opening therein for insertion and securement of the first hair grouping therein. A second hair grouping is charged into a second hair retainer comprising a perimeter member which is formed with an opening therein for insertion and securement of the second hair grouping therein. A third hair grouping is charged into a third hair retainer comprising a perimeter member which is formed with an opening therein for insertion and securement of the third hair grouping therein. Each of the hair retainers has a connector thereon for releasable connection to one of the other hair retainers. Each of the first, second and third hair retainers is manipulated to form a first braid stage and then the hair retainers are connected to each other to place them in side-by-side peripheral relation. Additional hair is charged into each of the outside hair retainers. The connectors are released and the first, second and third hair retainers are manipulated to form a second braid stage.

Additional objects and features of the invention will be in part apparent and in part pointed out hereinafter.

DETAILED DESCRIPTION OF THE INVENTION

Figure 1:
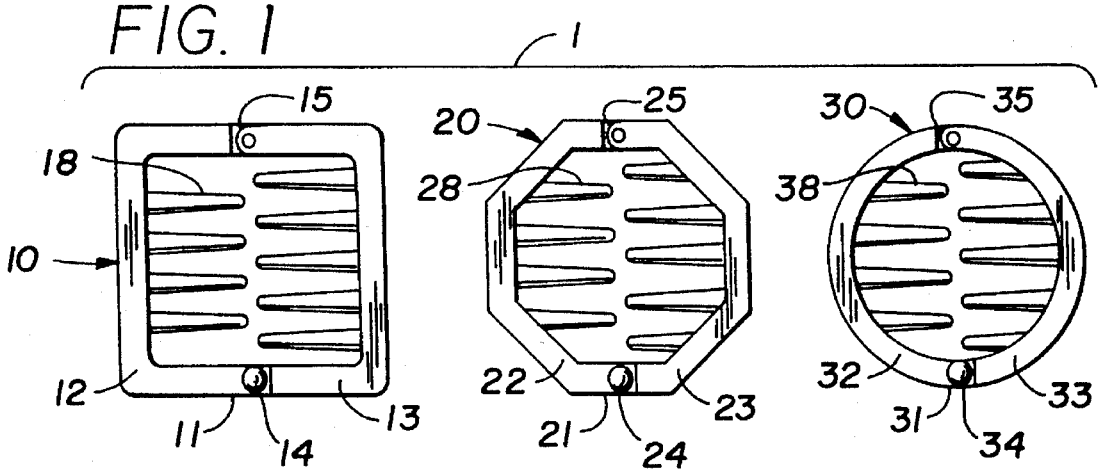
FIG. 1 is a front elevation of a preferred embodiment of the braiding device of the invention.
Figure 3:
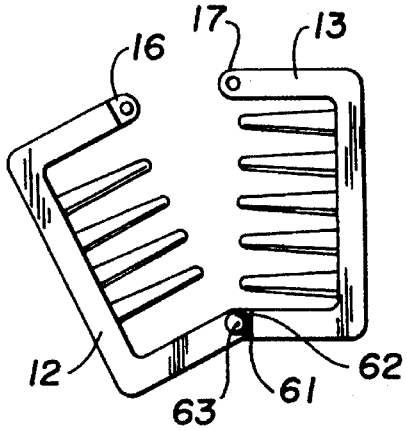
FIG. 3 is front elevation of one piece of the braiding device.

Turning now to FIG. 1, shown at reference numeral 1 is a particularly preferred embodiment of the invention consisting of a plurality of hair retainers consisting of two or more such retainers for holding separate groupings of hair. In the illustrated embodiment there are first hair retainer 10, second hair retainer 20, and third hair retainer 30. The retainer comprises a perimeter member which is formed with an opening therein for insertion and securement of a hair grouping. The preferred retainers are of generally annular shape and are split so as to define two mating perimeter halves. As shown, first hair retainer 10 includes first perimeter member 11 consisting of first perimeter halves 12 and 13. Hinge 14 permits perimeter member 11 to be moved from the closed position as shown in FIG. 1 to the open position as shown in FIG. 3. Fastener 15 (FIG. 1) releasably secures first hair retainer 11 in its closed position and preferably consists of button 16 and mating recess 17 (FIG. 3). There is also a gripper for frictionally gripping hair and securing it within the hair retainer. In the preferred embodiment shown, the gripper consists of a plurality of inwardly projecting teeth 18.

Second hair retainer 20 includes second perimeter member 21 consisting of second perimeter halves 22 and 23. Hinge 24 permits perimeter member 21 to be moved from the closed position as shown in FIG. 1 to an open position similar to that shown in FIG. 3 with respect to the first hair retainer. Fastener 25 releasably secures second hair retainer 21 in its closed position and preferably consists of a button and mating recess. There is also a gripper for frictionally gripping hair and securing it within the hair retainer. In the preferred embodiment shown, the gripper consists of a plurality of inwardly projecting teeth 28.

Third hair retainer 30 includes third perimeter member 31 consisting of third perimeter halves 32 and 33. Hinge 34 permits perimeter member 31 to be moved from the closed position as shown in FIG. 1 to an open position similar to that shown in FIG. 3 with respect to the first hair retainer. Fastener 35 releasably secures second hair retainer 31 in its closed position and preferably consists of a button and mating recess. There is also a gripper for frictionally gripping hair and securing it within the hair retainer. In the preferred embodiment shown, the gripper consists of a plurality of inwardly projecting teeth 38.

First hair retainer 10, second hair retainer 20, and third hair retainer 30 are square, octagonal, and circular, respectively. The different shapes of these members of the hair-braiding device serve as tactile indicators providing tactile feedback which allows one using the hair-braiding device to determine whether she is holding the first, second, or third retainer though she cannot see the retainers. Accordingly, the tactile indicators distinguish the respective retainers to the braider when they are in the braider's hair on the back of her head. Thus the braider knows whether she is holding the proper retainer when she is at a point in the braiding operation at which it is necessary to manipulate one particular of the three retainers. Although shown here as perimeter members in the shape of a square, octagon, and circle, the tactile indicators may also comprise other shapes, including, but not limited to, ovals, non-square rectangles and parallelograms, trapezoids, and diamonds. Various shapes will suffice so long as a different shape is used for each of the three perimeter members and so long as the shapes enable tactile distinguishing among the hair retainers.

In an alternative embodiment, the tactile indicators consist of markings, raised portions, indentations or the like on the three perimeter members which provide tactile feedback and render the respective members distinguishable. In particular, each of the three perimeter members may have an identical shape, such as the square shape of the first perimeter member in FIG. 1, with a raised "1," "2," or "3," or their braille equivalents, on each. Various markings will suffice so long as different markings are used on each of the three perimeter members and so long as the markings are distinguishable by touch.

As an optional feature of one preferred embodiment of the invention, each of the hair retainers is a different color. This feature allows the braider to distinguish between the respective hair retainers by observing them directly or in a mirror. Thus the braider is able to visually confirm, if necessary, the tactile feedback she is receiving as to whether she is holding the proper retainer when she is at a point in the braiding operation at which it is necessary to manipulate one particular of the three retainers.

Each of the hair retainers has a connector for connecting it to one or both of the other two hair retainers. The preferred connector, shown in FIG. 2, consists of outwardly facing grooves and ridges on the periphery of the hair retainers for frictionally interengaging each retainer with another in peripherally side-by-side relation. In the preferred embodiment shown, first hair retainer 10 can be connected to second hair retainer 20 by interfitting ridge 43 into groove 41 between ridges 40 and 42. Second hair retainer 20 can be connected to third hair retainer 30 by interfitting ridge 48 into groove 46 between ridges 45 and 47. This particular connector design permits connection in a variety of ways such that the precision required by the braider in connecting the retainers is reduced. As shown, for example, second hair retainer 20 can be connected to third hair retainer 30 by interfitting ridge 48 into groove 46 between ridges 45 and 47 or by interfitting ridge 50 into groove 46. The grooves and ridges are roughly the same width such that they can be interfitted and released without use of undue force. The ridges and grooves can be on the top, bottom and two sides of the retainers, or only on the sides. By having ridges and grooves as the connectors and having them occupy a substantial portion of the periphery as shown in the preferred embodiment, simple interconnection of the respective retainers is facilitated, thereby saving time in operation of the device because, as described below, operation of the device involves repeated interconnection and release of the hair retainers. Since part of the periphery is occupied by the hinge and closure mechanisms in the illustrated embodiment, though, the connectors in this embodiment do not extend completely around the entire periphery.

Figure 2:
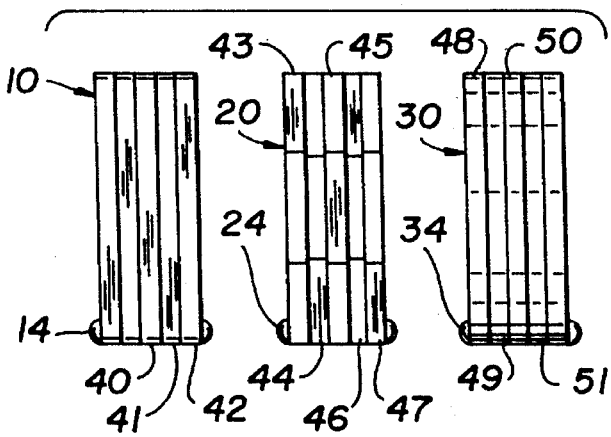
FIG. 2 is side elevation of the braiding device.

As an alternative to the connectors shown in FIG. 2, other connectors such as button-type fasteners, clips, a series of teeth-like components with mating recesses, or hooks can be used, so long as they provide for relatively easy releasable interconnection of the respective hair retainers.

Figure 5:
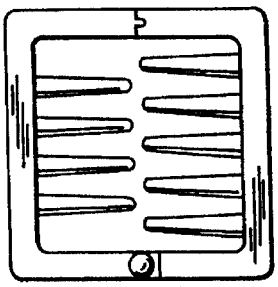
FIG. 5 is a front elevation of an alternative embodiment of one component of the braiding device.

As described briefly above, each of the hair retainers has a fastener (15, 25, 35) for securing the retainer in the closed position as shown in FIG. 1. The fastener as shown, for example, in FIG. 3 comprises a male closure member 16 at the closure end of a first perimeter half which is releasably securable to a female closure member 17 at the closure end of its respective mating second perimeter half. The closure provides releasable snap interengagement of each first perimeter half to its respective mating second perimeter half. Although shown as a pin and hole type fastener, alternative fasteners are appropriate, such as a button and recess shown in FIG. 5, so long as they provide for relatively easy releasable interconnection of the mating perimeter halves.

The hinges 14, 24, and 34 are preferably integrally molded with the perimeter halves. They are located at the hinge end of each perimeter half for hingedly securing each to its respective mating perimeter half at its hinge end. In the preferred embodiment shown in FIGS. 1 and 3, hinge 14 consists of a raised button 63 integral with a pin extending through perimeter half 13 and perimeter half 12. There is an identical button at the end of the pin on the reverse side of the retainer at the same position, as can be seen in FIG. 2. This arrangement ensures that halves 12 and 13 are fixedly interconnected at the button while permitting rotation of the two halves relative to each other upon opening and closing of the retainer. Semicircular formations 61 and 62 (FIG. 3) further facilitate this rotation.

Figure 8:
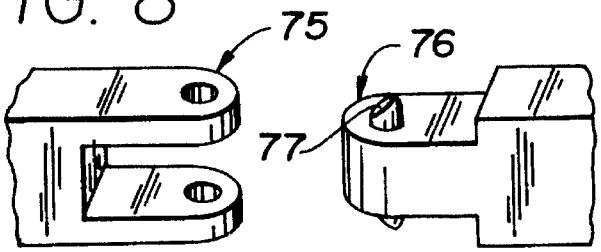
FIG. 8 is a perspective of one preferred embodiment of the hinge means used to connect to perimeter halves.

In one particularly preferred embodiment as shown in FIG. 8, there is female hinge member 75 and a male hinge member 76. There is a beveled hinge stud 77 on the male hinge member and, when initially assembling the device, the beveled portion forces the flanges of the female hinge member apart. When the hinge stud aligns with the holes in the female hinge member, the flanges of the female hinge member snap into place around the hinge stud, locking the two hair retainer halves together.

The preferred embodiment also includes a retainer orientation indicator means associated with each retainer. In the preferred embodiment shown, the retainer orientation indicator means is the raised portion 63 associated with or on the hinge portion of each retainer. This raised portion serves as a tactile indicator to provide feedback to the braider as to the orientation of the retainer. During operation of the device, it is preferred that each retainer be oriented as shown in FIG. 3, with the snap closure at the top of each retainer to facilitate opening of the retainer upwardly, such that gravity assists in loading hair into each retainer. The raised portion tactile indicator on the hinge assists the braider in maintaining this orientation in that it provides continuous feedback as to the orientation of each retainer. In alternative embodiments, the retainer orientation indicator means is not a raised portion associated with the hinge, but is another marking or indicia on another portion of the retainer, such as the circular indicia 74 near the closure shown in FIG. 4.

Although the perimeter members are described herein as "halves," each of the respective perimeter halves of the hair retainers is not required to be roughly half of the mass of each retainer. For example, in one alternative of the braiding device, one of the perimeter halves is a rectangle in which one perimeter half contains three of the rectangle's four sides. The respective perimeter halves in this alternative embodiment are "halves" in a functional sense in that each half is one-half responsible for the opening and closing function of the retainer. But, as far as the total mass of the retainer is concerned, one of the halves occupies significantly more than its mating half.

The device is preferably constructed from injection molded plastic, more preferably recyclable plastic. In the embodiment shown, the device consists of six separately molded plastic pieces, that is, two perimeter halves fixedly interfitted for each of the three hair retainers constituting the invention.

Figure 4:
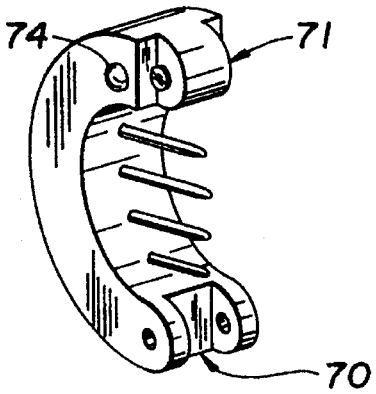
FIG. 4 is a perspective view of a perimeter half which forms a part of one component of the braiding device.

Each retainer perimeter half is preferably identical in basic structure, to facilitate manufacture from the same plastic injection mold. For example, as shown in FIG. 4, this perimeter half is a basic perimeter half which can be modified to be either 1) a perimeter half having a female hinge member and a male closure member or 2) a perimeter half having a male hinge member and a female closure member. In FIG. 4, the basic perimeter half has been modified to have a male closure member and a female hinge member. Before modification, the male portions snap closure and hinge portions are configured similarly and the female portions of the snap closure and hinge portions are configured similarly such that each perimeter half has one female end and one male end as shown. Two such perimeter halves of this nature form a complete retainer by having one half (shown in FIG. 4) provide the female portion of the hinge at its hinge end 70 and the male portion of the snap closure at its closure end 71 and having the second half (not shown in FIG. 4) provide the female portion of the snap closure at its closure end and the male portion of the hinge at its hinge end. By modifying the male portion of a perimeter half to provide relatively permanent and secure interengagement with a female portion, a hinge male portion is provided. By modifying the male portion to provide closure which is relatively easily releasable as shown in FIG. 4, a snap closure male portion is provided. In the illustrated embodiment, such modification is accomplished by insertion of a through-pin as shown which protrudes above the flat surface of the male portion sufficiently to allow the closure to be snapped into and away from a female closure end of a mating perimeter half.

In an alternative embodiment each retainer is constructed of one integral piece comprising two mating perimeter half portions with a flexible hinge positioned therebetween. The flexible hinge and two perimeter halves are molded as a single piece. A further alternative of this embodiment dispenses with the hinge, and the retainer is constructed of one piece of material which is itself sufficiently flexible to be opened to place hair therein. There is no hinge, but the retainer can be forced open for loading.

Figure 7:
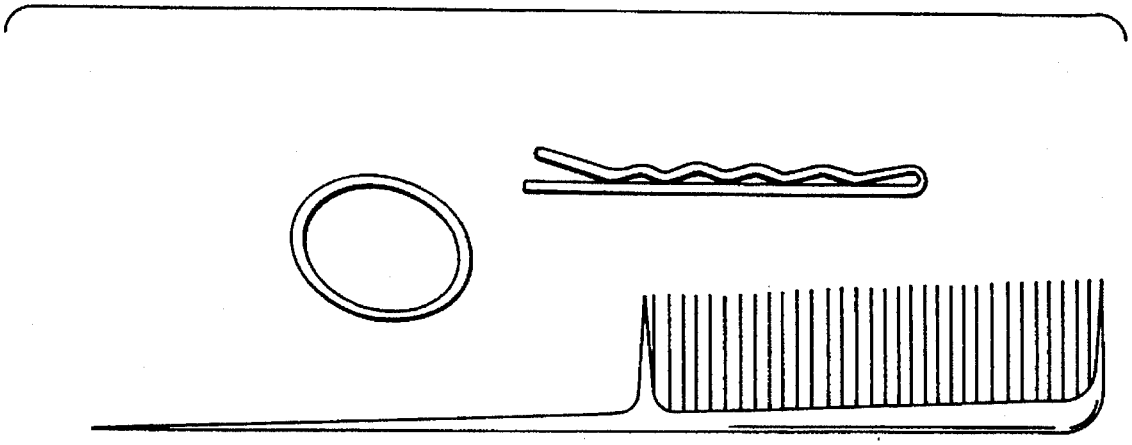
FIG. 7 is a view of items which, in addition to the device of FIG. 1, form the hair-braiding kit of the invention.

A complete kit comprising a compact carrying case, one or more bobby pins, one or more rubber bands or other elastic bands, and one or more combs may advantageously be provided along with the braiding device. The bobby pins facilitate tucking of hair under the braid. The elastic bands facilitate gathering together and maintaining hair at the bottom of the braid. The compact carrying case facilitates storage and transportation of the device and related kit items. The compact carrying case is optionally fitted with a small mirror, or there is a hand-held mirror otherwise included in the kit. The preferred comb is a rat tail comb of the type shown in FIG. 7 with markings thereon for use in measuring out consistent amounts of hair to be charged to the retainers during braiding. The preferred kit also includes written instructions and illustrations demonstrating various braiding methods. There is also optionally included a marker consisting of a small piece, such as a diamond-shaped piece of colored, transparent plastic, which is to be moved manually down the instruction sheet to assist the braider in keeping her place within the braiding operation sequence.

Figure 6:
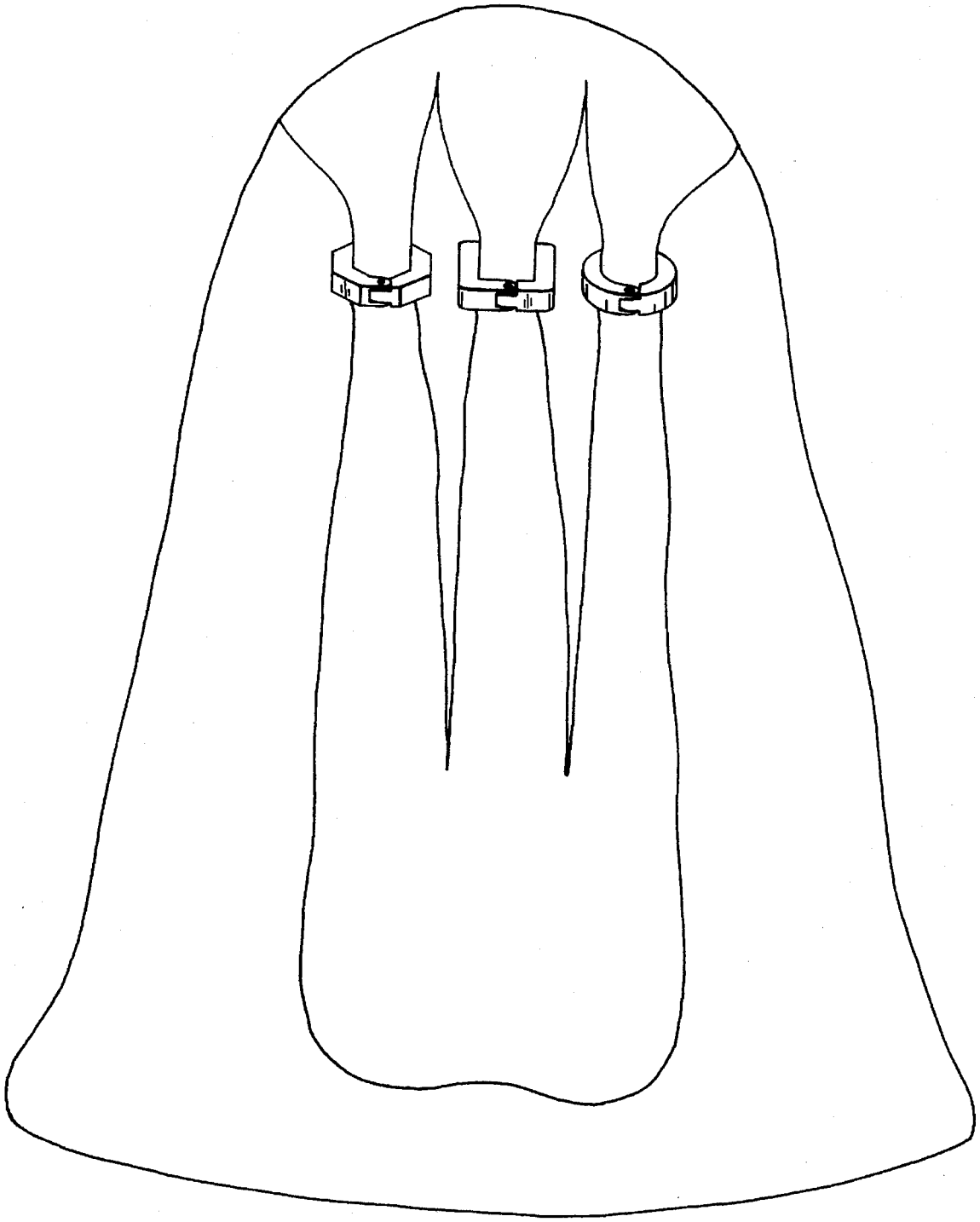
FIG. 6 is a front elevation of the braiding device with hair groupings therethrough at the beginning of a hair-braiding operation.
Figure 9A:
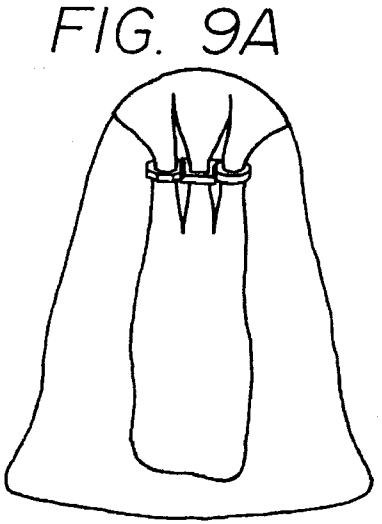
FIG. 9A–9P is a series of front elevations showing the hair-braiding device being used in connection with the braiding method of the invention.
Figure 9B:
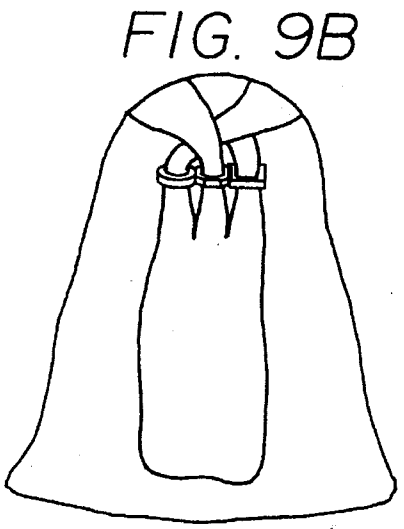
Figure 9C:
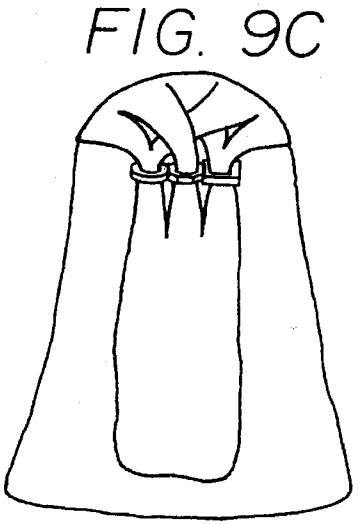
Figure 9D:
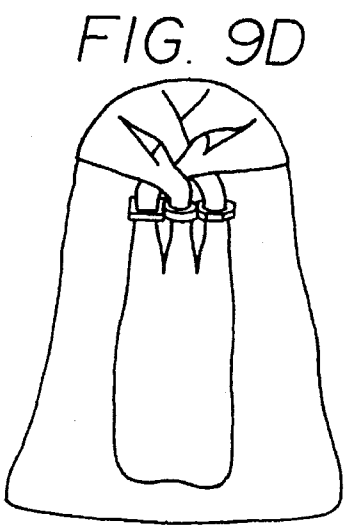
Figure 9E:
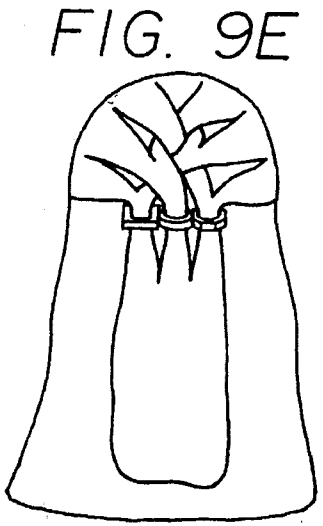
Figure 9F:
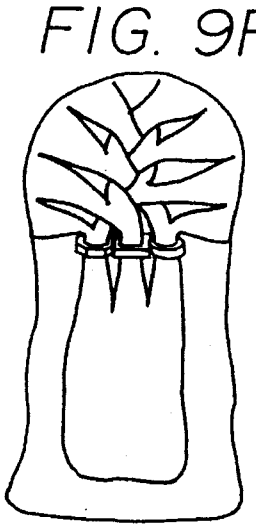
Figure 9G:
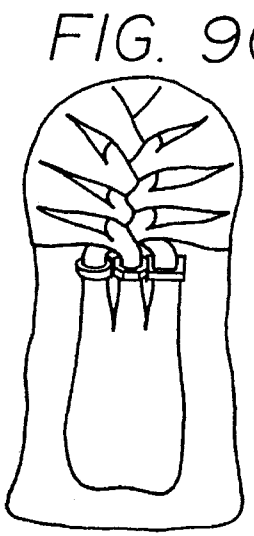
Figure 9H:
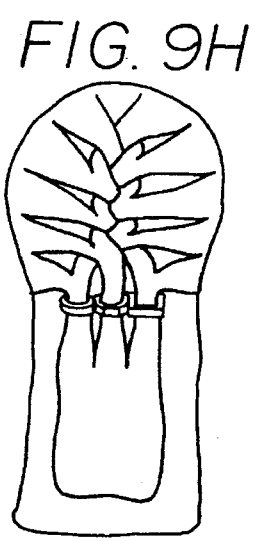
Figure 9L:
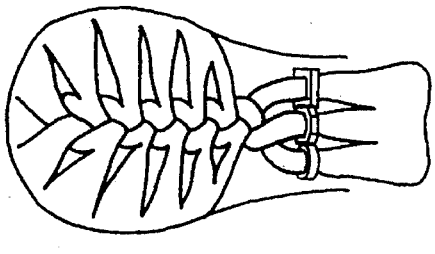
Figure 9P:
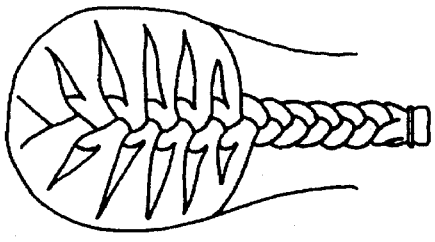
Figure 9K:
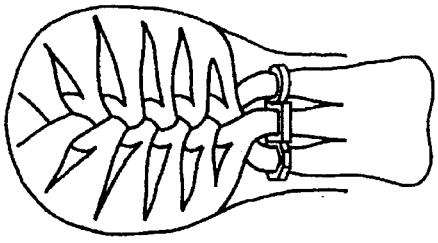
Figure 9O:
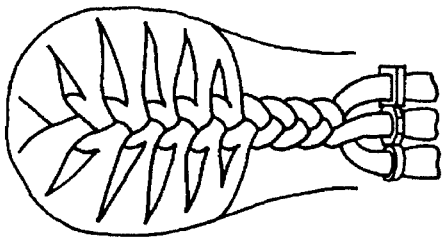
Figure 9J:
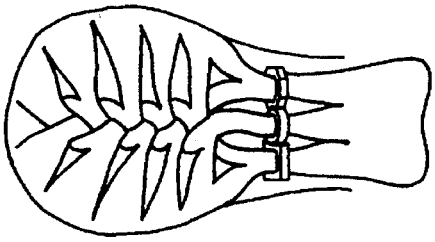
Figure 9N:
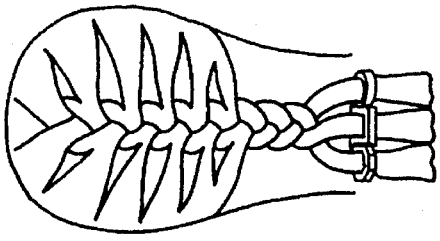
Figure 9I:
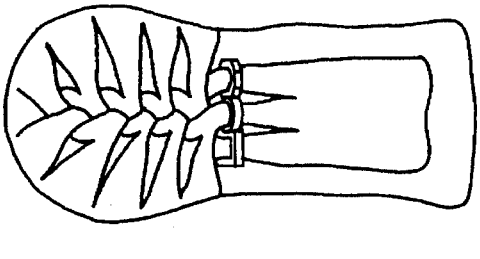
Figure 9M:
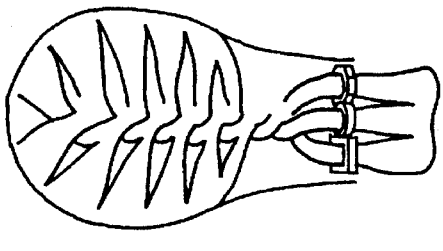

In operation of the hair-braiding device in accordance with the method of the invention to form a French braid, three hair groupings of relatively equal size are formed from the hair on the back of the head near the top of the head. To ensure that these groupings and subsequent groupings are of consistent volume, a rat tail comb having measuring marks thereon is optionally provided and is used to size up the groupings. The circular hair retainer is opened for receiving hair, the first hair grouping charged therein, and the hair retainer is closed. The upwardly opening orientation of the retainer is facilitated by the tactile feedback transmitted to the braider from the retainer orientation indicator means, that is, the raised hinge portion. The second and third hair groupings are similarly retained by the octagonal and square hair retainers. The hair retainers are positioned at roughly the same level in the hair and then interconnected by their respective side grippers such that from left to right in order are the octagonal, square and circular retainers in peripherally side-by-side relation as shown schematically in FIGS. 6 and 9 (although the specific starting order is not critical). Turning now to FIG. 9, steps (A) and (B) are carried out. The circular hair retainer is lifted over the square hair retainer and placed between the octagonal and square retainers. The octagonal hair retainer is then lifted over the circular retainer and placed between the circular and square retainers and a first braid stage as shown in FIG. 9A is thereby formed. The three retainers are then interconnected by their respective side connectors such that from left to right in order are the circular, octagonal and square retainers in peripherally side-by-side relation. They are therefore positioned in a left-outside position, a middle position, and a right-outside position. The outside retainers, in this example the circular and square retainers, are then opened, additional hair is loaded therein, and closed to provide the set-up shown in FIG. 9C. The process is then repeated, with the connections released and the square retainer (now on the far right) lifted over the octagonal retainer and placed between the circular and octagonal retainers. The circular retainer is then lifted over the square retainer and placed between the square and octagonal retainers and a second braid stage is thereby formed (as shown in FIG. 9D). The three retainers are interconnected by their respective side grippers such that from left to right in order are the square, circular and octagonal retainers in peripherally side-by side-relation. The outside retainers, here the square and octagonal retainers, are then opened, additional hair is loaded therein, and closed. The process is then repeated until all the hair on the body of the head is used up and the only available hair remaining is that hair hanging from the braid (up to FIG. 9J). This hair is secured with a basic braid (FIGS. 9K–9P) and then tied with a closure of choice, such as a bow or rubber band.

Throughout the braiding operation the braider keeps track of the sequence with the help of the tactile feedback provided by the different shapes of the retainers and written instructions making reference to such shapes. However, many braiders will not need to rely on this tactile feedback due to familiarity with the proper braiding sequence. Accordingly, one embodiment of the device of the invention does not have the tactile indicators which distinguish the respective retainers. Occasionally during the braiding operation, it is necessary to pull down on groupings to tighten the braid. The general sequence and operation is not different than well known braiding principles, except that the hair groupings are maintained within the retainers, thus keeping them consistent and freeing the braider's hands for manipulating the groupings and other tasks, rather than having to actually maintain the integrity of the groupings themselves. The tail created at the end of the braid is then secured with an elastic band, rubber band or similar device and/or tucked underneath the braid with one or more bobby pins or similar devices.

The method and device of the invention are for use in forming braids other than French braids, for example, French pigtails, Princess Anne braids, French overs, inside-out French braids, French ropes and others. Certain of these hairstyles involve the use of a number of hair groupings other than three, such that certain embodiments of the hair-braiding device of the invention include a number of hair retainers other than three.

Although specific examples of the present invention and its application are set forth it is not intended that they are exhaustive or limiting of the invention. These illustrations and explanations are intended to acquaint others skilled in the art with the invention, its principles, and its practical application, so that others skilled in the art may adapt and apply the invention in its numerous forms, as may be best suited to the requirements of a particular use.

What is claimed is:

1. A hair-braiding kit comprising:

a plurality of hair retainers for cooperative use in holding and braiding separate groupings of hair;

each of said hair retainers comprising a perimeter member which is formed with an opening therein for insertion and securement of one of said hair groupings therein;

each of said hair retainers having a tactile indicator with the tactile indicators of said hair retainers differing from one another for enabling tactile distinguishing among the hair retainers, said tactile indicators constituting a different shape of each hair retainer for enabling tactile distinguishing among the hair retainers;

each of said hair retainers being of generally annular shape and being split so as to define two perimeter halves; and each of said hair retainers having a connector thereon for releasable connection of said hair retainer to one of the other hair retainers.

2. A hair-braiding device comprising:

a plurality of hair retainers for holding separate groupings of hair;

each of said hair retainers comprising a perimeter member which is formed with an opening therein for insertion and securement of one of said hair groupings therein; and each of said hair retainers having a connector thereon for releasable connection to one of the other hair retainers.

3. The hair-braiding device of claim 2 wherein each hair retainer is of generally annular shape and its connector comprises outwardly facing peripheral grooves and ridges for frictionally interengaging each retainer with another in peripherally side-by-side relation.

4. The hair-braiding device of claim 3 wherein each retainer is split so as to define two mating perimeter halves.

5. The hair-braiding device of claim 3 wherein each retainer has a gripper means for frictionally securing a grouping of hair within the retainer.

6. The hair-braiding device of claim 2 wherein each of said hair retainers is of one-piece construction.

7. A hair-braiding kit comprising:

plurality of hair retainers for cooperative use in holding and braiding separate groupings of hair;

each of said hair retainers comprising a perimeter member which is formed with an opening therein for insertion and securement of one of said hair groupings therein;

each of said perimeter members being split so as to comprise a first perimeter half and a respective mating second perimeter half;

each of said first perimeter halves and each of said respective mating second perimeter halves having a hinge end and a closure end, the hinge end of each of said first perimeter halves being hingedly secured to the hinge end of its respective mating second perimeter half;

the closure end of each of said first perimeter halves being releasably securable to the closure end of its respective mating second perimeter half by means of a snap closure member at the closure end of each first perimeter half and a snap closure member at the closure end of each second perimeter half for releasable snap interengagement of each first perimeter half to its respective mating second perimeter half; and each of said hair retainers having a connector thereon for releasable connection to one of the other hair retainers.

8. The hair-braiding device of claim 7 wherein each hair retainer is of generally annular shape and its connector comprises outwardly facing peripheral grooves and ridges for frictionally interengaging each retainer with another in peripherally side-by-side relation.

9. A method for braiding hair comprising:

charging a first hair grouping into a first hair retainer comprising a perimeter member which is formed with an opening therein for insertion and securement of said first hair grouping therein;

charging a second hair grouping into a second hair retainer comprising a perimeter member which is formed with an opening therein for insertion and securement of said second hair grouping therein;

charging a third hair grouping into a third hair retainer comprising a perimeter member which is formed with an opening therein for insertion and securement of said third hair grouping therein;

each of said hair retainers having a connector thereon for releasable connection to one of the other hair retainers;

manipulating each of said first, second and third hair retainers to form a first braid stage;

connecting the hair retainers to each other to place them in side-by-side peripheral relation such that they are positioned in a left-outside position, a middle position, and a right-outside position;

charging additional hair into each of the retainers at the left-outside and right-outside positions; and releasing the connectors and manipulating the first, second and third hair retainers to form a second braid stage.

10. A hair-braiding kit comprising:

a plurality of hair retainers for cooperative use in holding and braiding separate groupings of hair;

each of said hair retainers comprising a perimeter member which is formed with an opening therein for insertion and securement of one of said hair groupings therein;

each of said hair retainers having a tactile indicator with the tactile indicators of said hair retainers differing from one another for enabling tactile distinguishing among the hair retainers; and written instructions associated with the hair retainers describing a braiding method involving use of the hair retainers in holding separate groupings of hair and manipulating the positions of the hair retainers with respect to each other in braiding separate groupings of hair held within the hair retainers.

11. The hair-braiding device of claim 10 wherein each of said hair retainers has a connector thereon for releasable connection of said hair retainer to one of the other hair retainers.

12. A hair-braiding kit comprising:

a plurality of hair retainers for cooperative use in holding and braiding separate groupings of hair;

each of said hair retainers comprising a perimeter member which is formed with an opening therein for insertion and securement of one of said hair groupings therein;

each of said perimeter members being split so as to comprise a first perimeter half and a respective mating second perimeter half;

each of said first perimeter halves and each of said respective mating second perimeter halves having a hinge end and a closure end, the hinge end of each of said first perimeter halves being hingedly secured to the hinge end of its respective mating second perimeter half;

the closure end of each of said first perimeter halves being releasably securable to the closure end of its respective mating second perimeter half; and written instructions associated with the hair retainers describing a braiding method involving use of the hair retainers in holding separate groupings of hair and manipulating the positions of the hair retainers with respect to each other in braiding separate groupings of hair held within the hair retainers.

13. The hair-braiding device of claim 12 wherein each of said hair retainers has a connector thereon for releasable connection of said hair retainer to one of the other hair retainers.

* * * * *